US006994417B2

(12) United States Patent
Murayama et al.

(10) Patent No.: US 6,994,417 B2
(45) Date of Patent: Feb. 7, 2006

(54) LIQUID DISCHARGE DETECTION METHOD AND APPARATUS AND INK-JET PRINTER APPARATUS

(75) Inventors: Hiroyuki Murayama, Kanagawa (JP); Hiroyuki Ishinaga, Tokyo (JP); Yoshinori Misumi, Tokyo (JP); Takahiro Matsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/863,278

(22) Filed: Jun. 9, 2004

(65) Prior Publication Data

US 2005/0007410 A1 Jan. 13, 2005

Related U.S. Application Data

(63) Continuation of application No. PCT/JP02/13370, filed on Dec. 20, 2002.

(30) Foreign Application Priority Data

Dec. 27, 2001 (JP) ..... 2001-397874

(51) Int. Cl.
*B41J 29/393* (2006.01)

(52) U.S. Cl. ..... 347/19

(58) Field of Classification Search ..... 347/19, 347/74, 29, 81, 14, 17, 6
See application file for complete search history.

(56) References Cited

U.S. PATENT DOCUMENTS

| | | | |
|---|---|---|---|
| 4,313,124 | A | 1/1982 | Hara |
| 4,345,262 | A | 8/1982 | Shirato et al. |
| 4,459,600 | A | 7/1984 | Sato et al. |
| 4,463,359 | A | 7/1984 | Ayata et al. |
| 4,558,333 | A | 12/1985 | Sugitani et al. |
| 4,723,129 | A | 2/1988 | Endo et al. |
| 4,740,796 | A | 4/1988 | Endo et al. |

FOREIGN PATENT DOCUMENTS

| | | |
|---|---|---|
| JP | 59-123670 | 7/1984 |
| JP | 59-138461 | 8/1984 |
| JP | 3-29338 | 3/1991 |
| JP | 3-202354 | 9/1991 |
| JP | 11-170569 | 6/1999 |

*Primary Examiner*—Lamson Nguyen
(74) *Attorney, Agent, or Firm*—Fitzpatrick, Cella, Harper & Scinto

(57) ABSTRACT

In a liquid discharge detection method and apparatus which detect a liquid discharged from a liquid discharge head, an electrode is placed at a position where the liquid discharged from the liquid discharge head comes into contact with the electrode while being in contact with the head. When a liquid is discharged, and the head is connected to the electrode through the liquid, the circuit becomes a closed circuit. A voltage generated between the two ends of a resistor is obtained from a current flowing in the closed circuit. When this voltage becomes equal to or higher than a predetermined voltage, liquid discharge can be detected.

22 Claims, 11 Drawing Sheets

6
8
9
11
13
V 6
8
9
11
13
V
r
R
L
x
s(x)
l(x)
L0
L1

LIQUID DISCHARGE DETECTION METHOD AND APPARATUS AND INK-JET PRINTER APPARATUS

This application is a continuation of Application No. PCT/JP02/13370 filed Dec. 20, 2002.

TECHNICAL FIELD

The present invention relates to a liquid discharge detection method and apparatus which detect the discharge state of a liquid from a head, and an ink-jet printer apparatus.

BACKGROUND ART

Conventionally, as a method of detecting the discharge/non-discharge of ink from an ink-jet head or the discharge state of ink, for example, the ink droplet detector disclosed in Japanese Patent Laid-Open No. 11-170569 is available. This detector has a function of determining the discharge state of ink from the ink-jet head. Upon detecting a nozzle that discharges no ink, the detector notifies the user of the ink-jet printer with an error warning or the like, thereby allowing the user to prevent printing of any faulty image.

The disclosed technique of detecting the discharge/non-discharge of ink however, has the following problems.

(1) An ink droplet is charged, and whether ink is discharged or not is detected by detecting charge (induced charge) when the ink droplet passes. However, the charge given to an ink droplet concentrates on the surface of the ink droplet, and hence the detectivity based on such an ink droplet is low. If the amount of ink discharged is small, in particular, only a slight output can be obtained, posing a problem in terms of reliability.

(2) In order to solve problem (1) described above, the electric field between the ink-jet head and the ink detector may be increased by applying a high voltage of about 100 V between them so as to increase the amount of charge given to an ink droplet. This, however, requires an enormous cost, and a high voltage is generated and applied inside the apparatus, posing a problem in terms of safety.

(3) In addition, since a larger amount of charge given to ink droplets must be collected, charge must be detected from a plurality of ink droplets. This takes more time, and the amount of ink waste increases because a plurality of ink droplets are discharged. In addition, when detection is performed on the basis of a plurality of ink droplets in this manner, the average of the detected values of a plurality of ink droplets is used as a detection result. It is therefore difficult to detect a fluctuation or variation in each ink droplet.

SUMMARY OF THE INVENTION

The present invention has been made in consideration of the prior art described above, and has as its object to provide a liquid discharge detection method and apparatus which can accurately detect whether a liquid is discharged from a head, and an ink-jet printer apparatus.

It is another object of the present invention to provide a liquid discharge detection method and apparatus which can accurately detect whether a liquid is discharged from a head without using any high voltage, and an ink-jet printer apparatus.

It is still another object of the present invention to provide a liquid discharge detection method and apparatus which can accurately detect whether a liquid is discharged from a head even with a small amount of liquid, and an ink-jet printer apparatus.

Other features and advantages of the present invention will be apparent from the following descriptions taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the descriptions, serve to explain the principle of the invention.

FIGS. 8A and 8B depict views for explaining the arrangement of the ink-jet printer apparatus according to this embodiment, in which FIG. 8A shows a schematic view when viewed from the front, and FIG. 8B shows a schematic view when viewed from the side;

DETAILED DESCRIPTION OF THE PREFERRED EMBODIMENTS

The preferred embodiments of the present invention will be described in detail below with reference to the accompanying drawings.

[First Embodiment]

Figure 1A:
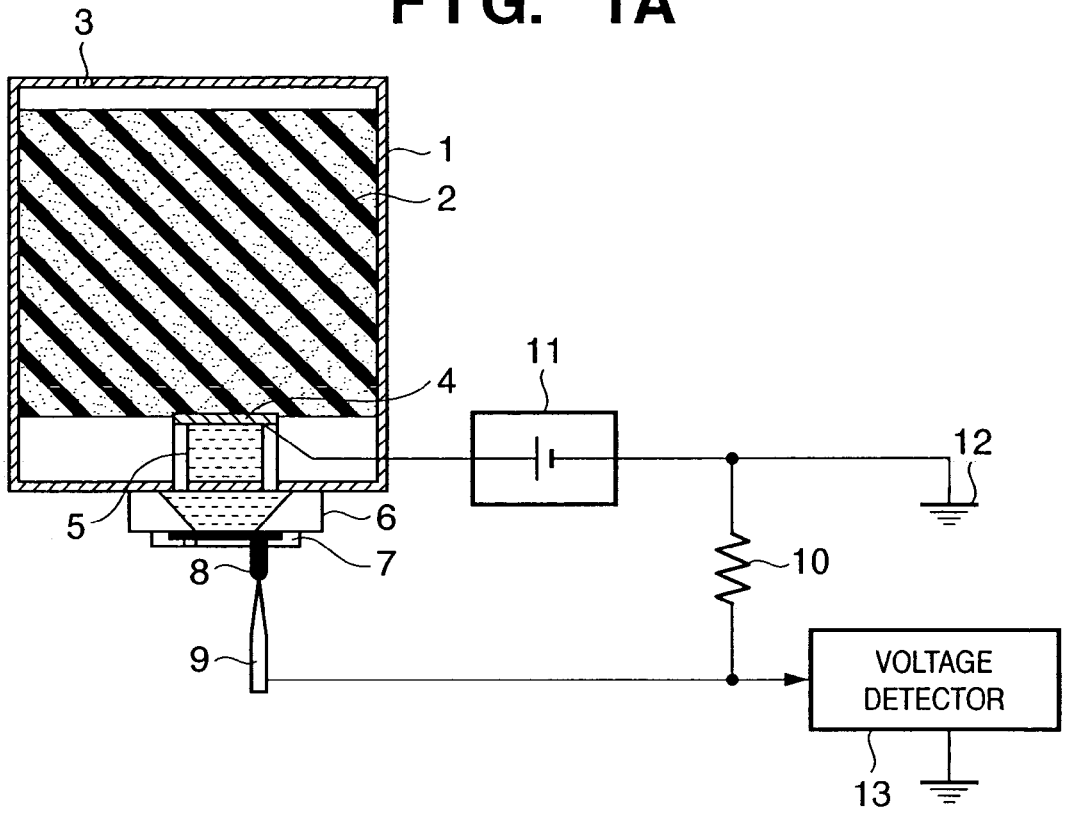
FIGS. 1A and 1B depict conceptual views for explaining an arrangement for detecting ink discharge/non-discharge according to an embodiment of the present invention.
Figure 1B:
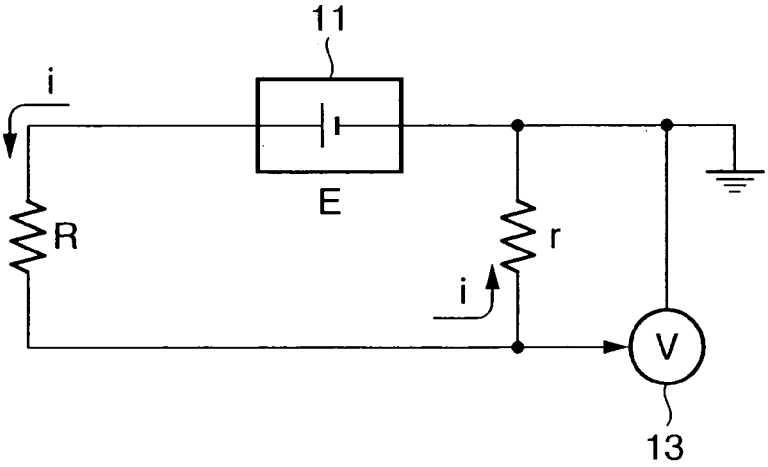

FIGS. 1A and 1B depict views for explaining the detection of ink discharge according to the first embodiment of the present invention. FIG. 1A is a view for explaining the principle of the detection. FIG. 1B is an equivalent circuit diagram for explaining an equivalent circuit at the time of ink detection.

An ink absorber 2 is housed in an ink cartridge 1, and ink is absorbed and held by the capillary attraction of the ink absorber 2. Ink is supplied from the ink absorber 2 to an ink-jet head 6 via a filter 4 for filtering dust and the like and a channel 5 serving as an ink channel. Reference numeral 3 denotes an air hole formed in the ink cartridge 1. The ink-jet head 6 has a nozzle layer 7 which is formed of a resin or the like and has a nozzle for discharging ink. In each nozzle layer 7, ink is heated and foamed by a discharge heater (not shown) provided on an element board in correspondence with each nozzle, and is discharged outside from the nozzle. The ink discharged in this manner initially forms a columnar shape. The ink then becomes spherical due to the surface tension and the like of the ink and separates from the head. FIG. 1A shows a case wherein this discharged ink is initially in a columnar form as indicated by reference numeral 8.

The main part of the ink discharge detection apparatus will be described next.

The ink 8 discharged in this manner comes into contact with an electrode 9. This electrode 9 has a needle-like shape. The filter 4 which is a conductor and functions as an electrode on the ink cartridge 1 side is connected to the electrode 9 through a voltage dividing resistor 10 for dividing a voltage. The electrode 9 is connected to the voltage dividing resistor 10 through a voltage detector 13. The node of the negative electrode of a power supply 11 and the voltage dividing resistor 10 are connected to a ground 12.

When the ink 8 is discharged from the nozzle layer 7 of the ink-jet head 6 and comes into contact with the electrode 9 while the ink is in a columnar shape and is not separated from the nozzle layer 7 of the head, this circuit is set in a closed state (closed circuit) through the ink (having conductivity). As a consequence, a current i flows in this closed circuit. FIG. 1B represents this state by an equivalent circuit.

Referring to FIG. 1B, reference symbol E denotes the power supply voltage of the power supply 11; reference symbol R denotes the electric resistance from the filter 4 to the electrode 9 with the ink and the ink column 8 coming therebetween; reference symbol r denotes the resistance value of the voltage dividing resistor 10; and reference symbol i denotes the current flowing in this closed circuit. In this state, an output V from the voltage detector 13 with respect to the electric resistance R at the ink portion is given by $$V=E\times r/(R+r)$$

Note that in this embodiment, the distance from the nozzle layer 7 of the ink-jet head 6 to the electrode 9 is set to 0.05 [mm], power supply voltage E=20 [V], and voltage-dividing resistance r=14 [MΩ].

The discharge state of ink and the state of a voltage output from the voltage detector 13 will be described next with reference to FIGS. 2A to 2D and FIG. 3.

FIGS. 2A to 2D depict views for explaining how the ink 8 is discharged from the ink-jet head 6 and comes into contact with the electrode 9. FIG. 3 is a graph showing changes in voltage value detected by the voltage detector 13 in the states shown in FIGS. 2A to 2D.

Figure 2A:
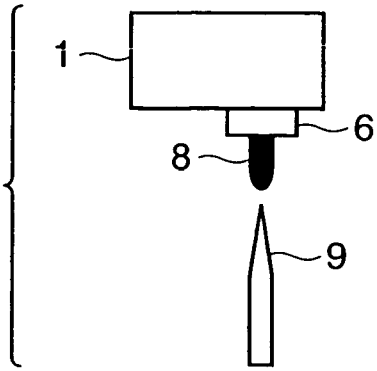
FIGS. 2A to 2D depict views for explaining how ink is discharged from an ink-jet head and comes into contact with an electrode.
Figure 3:
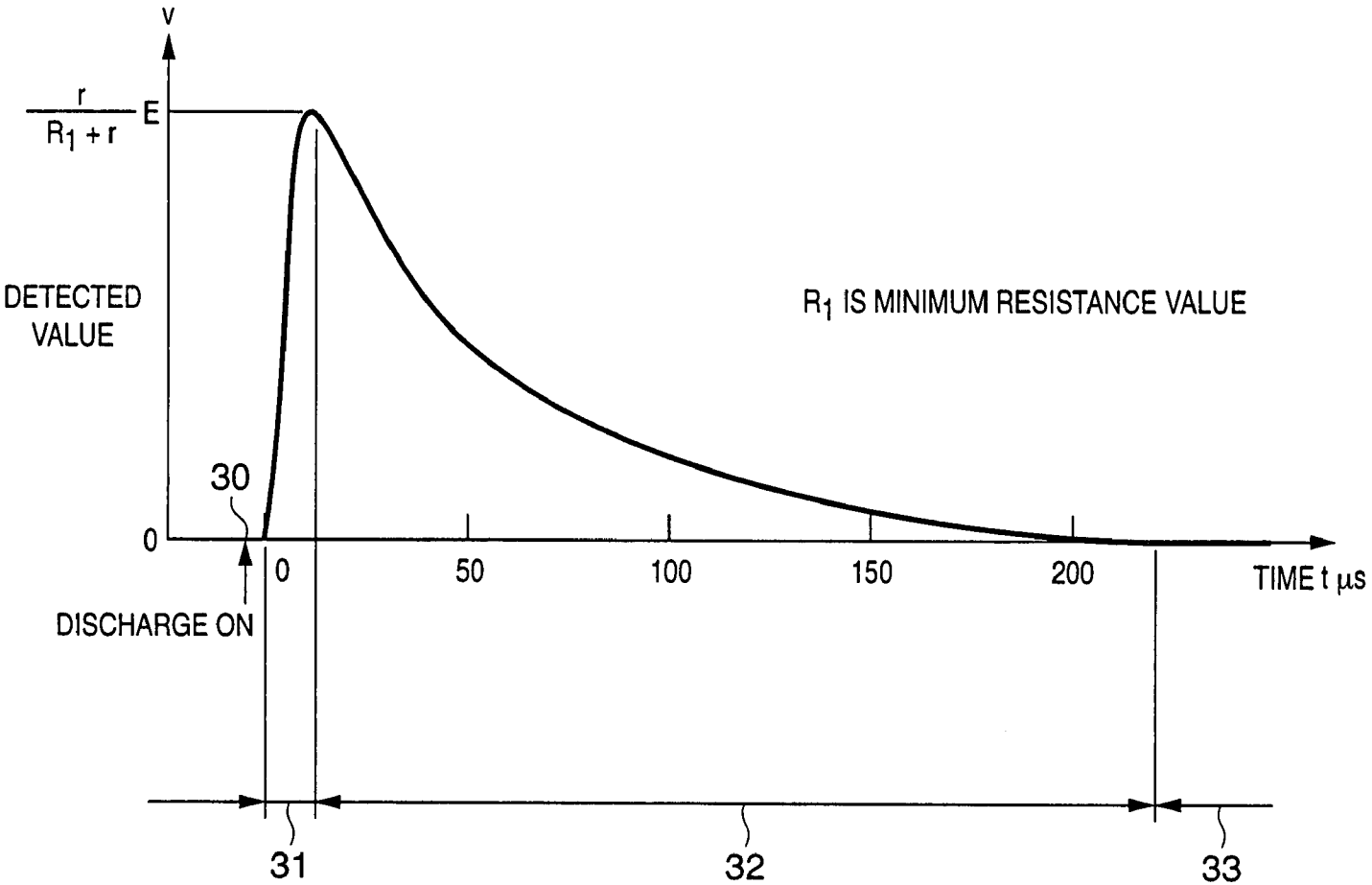
FIG. 3 depicts a graph showing changes in voltage value detected by a voltage detector in the states shown in FIGS. 2A to 2D.

FIG. 2A shows a state immediately after the ink-jet head 6 is driven and the ink 8 is discharged, in which the ink 8 is not in contact with the electrode 9. In this state, the voltage detected by the voltage detector 13 is almost 0 [V] as indicated on an ordinate V of FIG. 3 ("30" in FIG. 3).

Figure 2B:
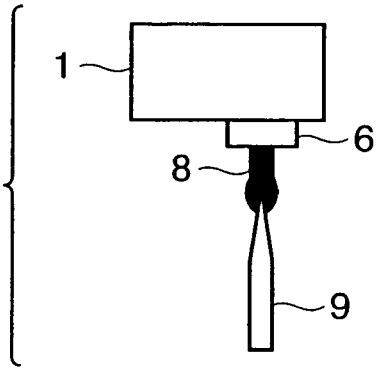

FIG. 2B shows a state wherein the ink 8 discharged from the ink-jet head 6 comes into contact with the electrode 9, and the head 6 is electrically connected to the electrode 9. The voltage detected by the voltage detector 13 at this time exhibits an abrupt increase, as indicated on the ordinate V in an interval 31 in FIG. 3, and increases up to V=E×r/(R1+r). In this case, a resistance value R1 is the minimum resistance value of the electric resistance R of the ink 8.

Figure 2C:
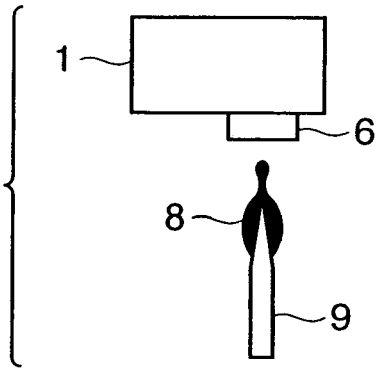

FIG. 2C shows a state wherein the ink 8 discharged from the ink-jet head 6 is separated from the nozzle of the head 6, i.e., from the filter 4. In this case, in the circuit shown in FIG. 1B, the portion of the resistance R is open (open state).

At this time, as indicated by an interval 32 in FIG. 3, the voltage V detected by the voltage detector 13 gradually decreases (the reason for this will be described later with reference to FIG. 4).

Figure 2D:
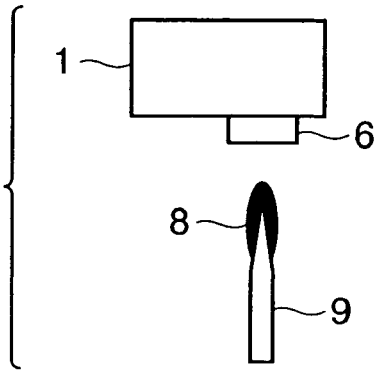

FIG. 2D shows a state wherein the ink 8 discharged from the ink-jet head 6 almost completely adheres to the electrode 9 and exhibits no movement. The voltage input to the voltage detector 13 at this time is almost 0 [V], as indicated by an interval 33 in FIG. 3.

This operation will be described in more detail below with reference to FIGS. 4A–4D.

FIGS. 4A to 4D depict views for explaining the states of the equivalent circuit in FIG. 1B which correspond to the respective states shown in FIGS. 2A to 2D.

Figures 4A, 4B, 4C, 4D:
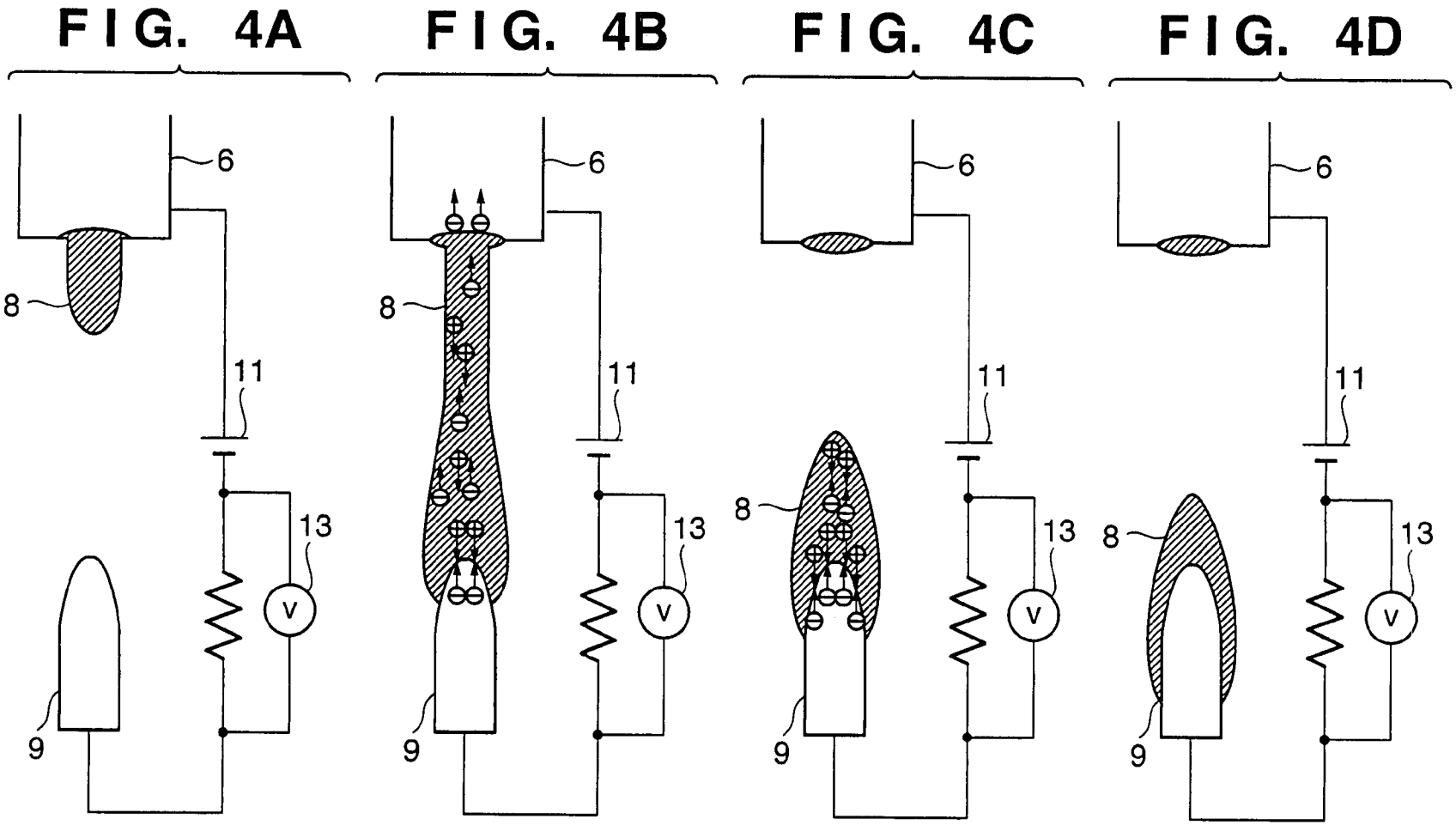
FIGS. 4A to 4D depict views for-explaining the states of an equivalent circuit in FIG. 1B which correspond to the respective states shown in FIGS. 2A to 2D.

FIG. 4A corresponds to FIG. 2A and shows a state immediately before the ink-jet head 6 is driven to discharge ink. In this state, the equivalent circuit shown in FIG. 1B is in the open state.

In the state wherein the ink 8 discharged from the ink-jet head 6 comes into contact with the electrode 9 while having a columnar shape as shown in FIG. 2B, a voltage is applied between the two ends of the ink 8, as shown in FIG. 4B. This causes convection of negative and positive ions within the ink 8, and the ions are respectively attracted to the ink-jet head 6 serving as a positive pole and the electrode 9 serving as a negative pole, thus causing an electrolytic phenomenon. As a consequence, a current flows in the ink 8. In addition, as the contact area between the ink 8 and the electrode 9 increases, the electric resistance of the ink 8 decreases. This resistance value decreases to the minimum resistance value R1. At this time, the current flowing in the ink 8 becomes maximum, and V=E×r/(R1+r), the maximum voltage, is detected by the voltage detector 13.

Referring to FIG. 4C, the ink 8 separates from the ink-jet head 6 and is received by the electrode 9, as shown in FIG. 2C. At this time, the ion convection that has occurred in the ink remains on the electrode 9, and the electrolytic reduction reaction continues on the electrode 9. As a consequence, as indicated by the interval 32 in FIG. 3, the current gradually decreases and so does the voltage value. In due time, the current becomes extinct and the voltage detected by the voltage detector 13 becomes 0 V. This residual current prolongs the detection time of the output voltage detected by the voltage detector 13, thereby improving the detectivity of ink.

FIG. 4D shows a state wherein the droplet of the ink 8 is completely received by the electrode 9, as shown in FIG. 2D. In this state, convection of positive and negative ions within the received ink stops again, and the ink is neutralized. As a consequence, the voltage detected by the voltage detector 13 becomes almost 0 V.

Figures 5A, 5B, 5C:
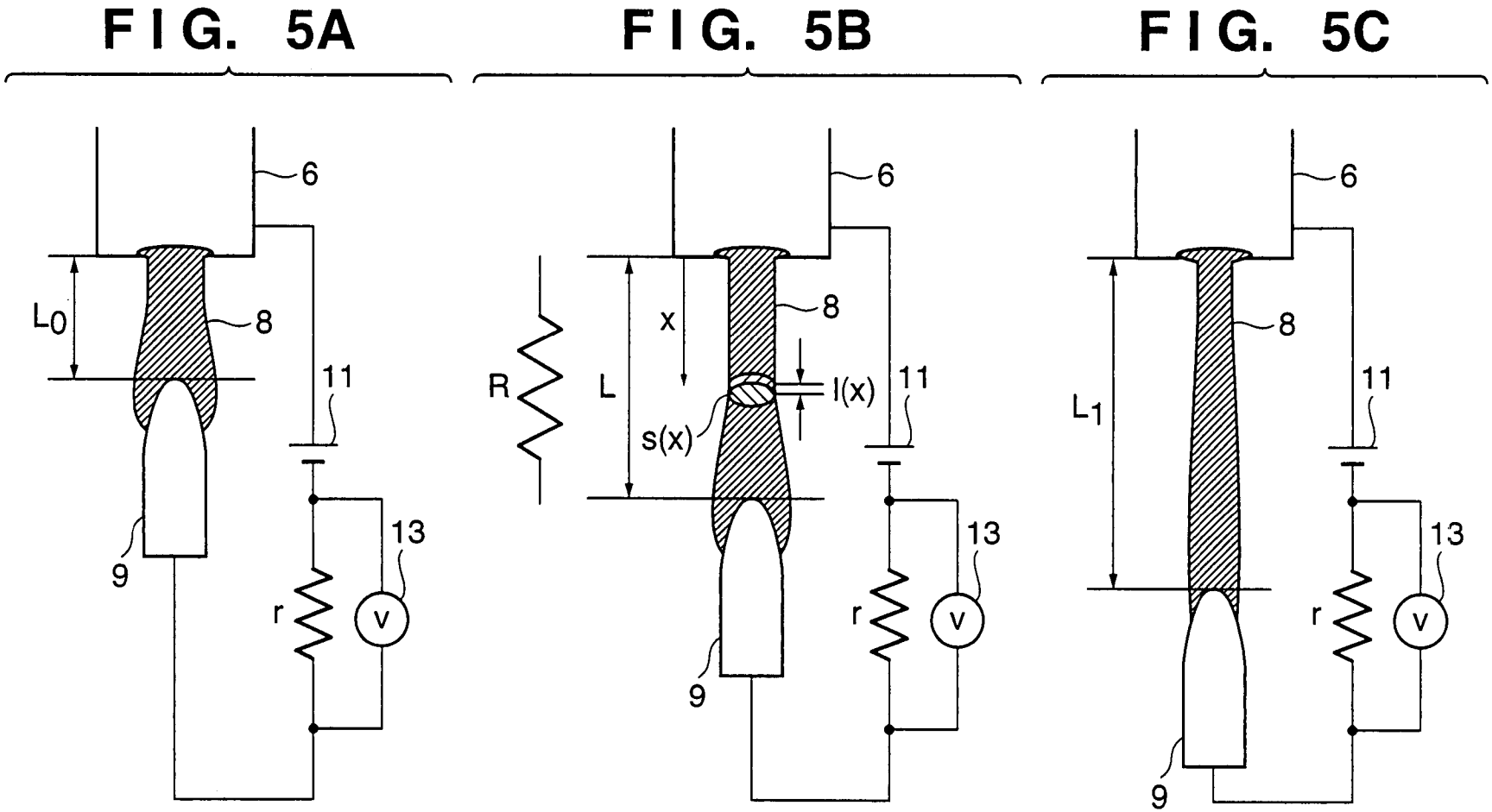
FIGS. 5A to 5C depict views for explaining how an ink column is formed when a distance L between the ink-jet head and the electrode changes.

FIGS. 5A to 5C depict views for explaining how the columnar ink 8 forms when a distance L between the ink-jet head 6 and the electrode 9 changes. FIG. 5A shows a case wherein the distance L is L0. FIG. 5B shows a case of the distance L. FIG. 5C shows a case wherein the distance L is L1 (L0<L<L1).

Referring to FIGS. 5A to 5C, letting A be the specific resistance coefficient of the ink itself, L be the length of the ink, and S(x) be the cross-sectional area of the ink column at a distance x from the head 6, the electric resistance R is expressed by the equation below. In the equation, it is found that the electric resistance R including the ink 8 decreases as the distance L between the ink-jet head 6 and the electrode 9 decreases and the cross-sectional area S of the column ink 8 increases.

$$R = A \times \sum_{x=0}^{x=L} l(x)/S(x)$$

In this embodiment, the distance L was set to 200 [μm] or less to allow the ink 8 in a columnar form to come into contact with the electrode 9 while it stays in contact with the nozzle layer of the head 6. This distance depends on the properties of the ink and the discharge velocity of the discharged ink. In this embodiment, ink viscosity η=2.0 [CP], surface tension γ=40 [dyn/cm], and discharge velocity v =10 [m/s] or more. In addition, in order to allow the ink 8 to have a columnar shape and be in contact with the head 6 and the electrode 9 at the same time, when distance L>200 [μm], the physical properties of the ink must be changed to elongate the ink 8 without breaking the column. In this case, in consideration of stability in ink detection as well, the following conditions are preferable: ink viscosity η=2.5 [CP], surface tension γ=30 [dyn/cm] or more, and discharge velocity v =12 [m/s] or more.

When the distance L becomes shorter than 5 [μm], the ink stays adhered to the head 6 and electrode 9, and the head 6 and electrode 9 may be kept electrically connected to each other. Although it depends on the diameter of an ink droplet, since the diameter of an ink droplet is about 5.7 [μm] in the case of ink with 0.1 [pl], the distance L is preferably set to satisfy 5 [μm]<L≦200 [μm].

Figure 6A:
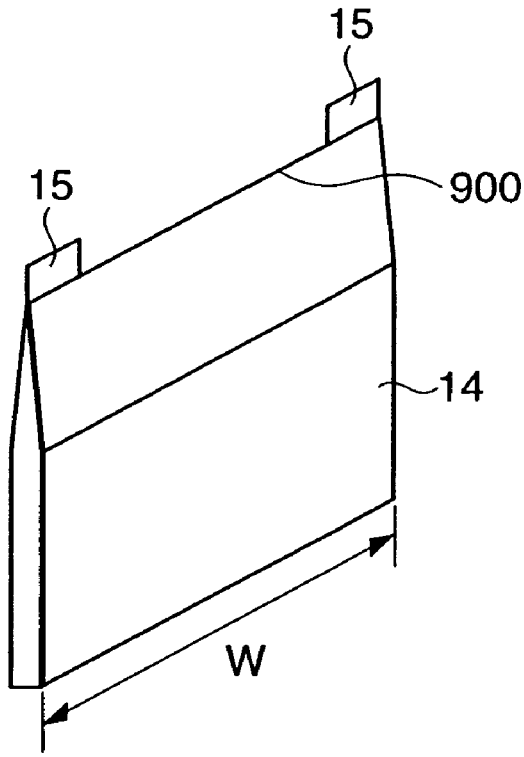
FIGS. 6A and 6B depict views for explaining the shapes of electrodes according to this embodiment.
Figure 6B:
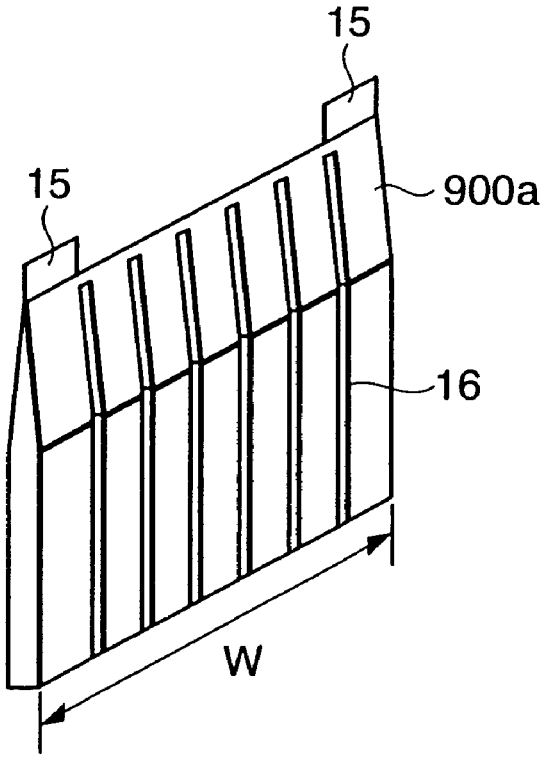

FIGS. 6A and 6B depict views for explaining an electrode 9 according to another embodiment.

In this embodiment, an electrode 900 is in the form of a razor edge and has a length W almost equal to the length of the nozzle array of an ink-jet head 6. The electrode 900 also has spacers 15 so as not to come into contact with the ink-jet head 6. Reference numeral 14 denotes an electrode unit. A water immersion process is performed for the surface of the electrode 900 to allow the ink discharged from the ink-jet head 6 to be quickly absorbed by the edge surface without staying. Alternatively, as indicated by an electrode 900*a* in FIG. 6B, a plurality of liquid absorbing grooves 16 are formed to prevent ink from staying on the electrode 900. This makes it possible to improve the reliability in ink discharge detection.

The above description is about the arrangement for detecting ink discharge from each nozzle of the ink-jet head in this embodiment. A case wherein such a function is provided for an ink-jet printer apparatus will be described below.

Figure 7:
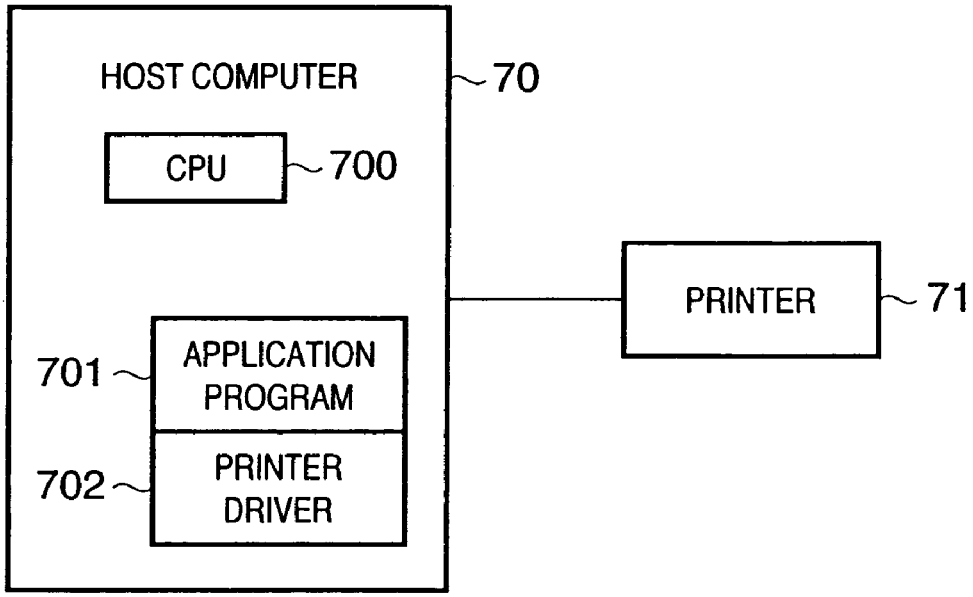
FIG. 7 is a block diagram showing the arrangement of a print system having the ink-jet printer apparatus according to this embodiment.

FIG. 7 is a block diagram showing the arrangement of a print system having a printing apparatus according to this embodiment.

Referring to FIG. 7, a host computer 70 and printing apparatus 71 are connected directly or through a LAN. The host computer 70 has a CPU 700 which executes various application programs, an OS, and the like to control the operation of the host computer 70. The host computer 70 also has a printer driver 702 for controlling the printing operation of the printing apparatus 71. This printer driver 702 receives print data from an application program 701, converts it into a command or data format that can be interpreted by the printing apparatus 71, and outputs it to the printing apparatus 71.

The printing apparatus 71 has a function of detecting discharge/non-discharge of ink from each nozzle of the ink-jet head described above. The detection result may be sent from the printing apparatus 71 to the host computer 70 to be notified to the user through the printer driver 702.

Figure 8B:
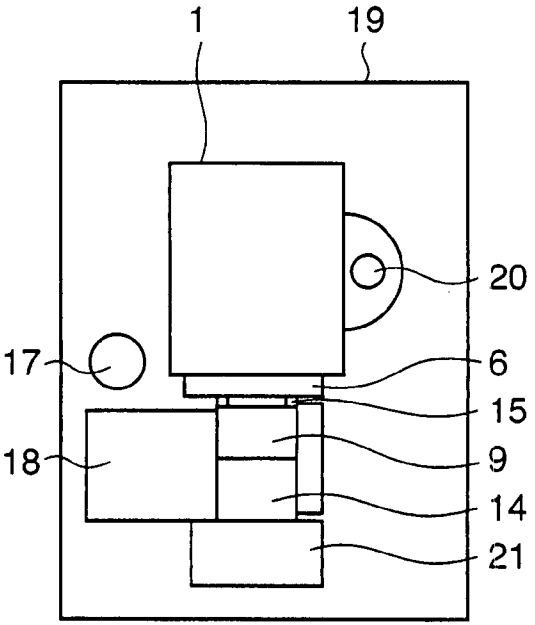
Figure 8A:
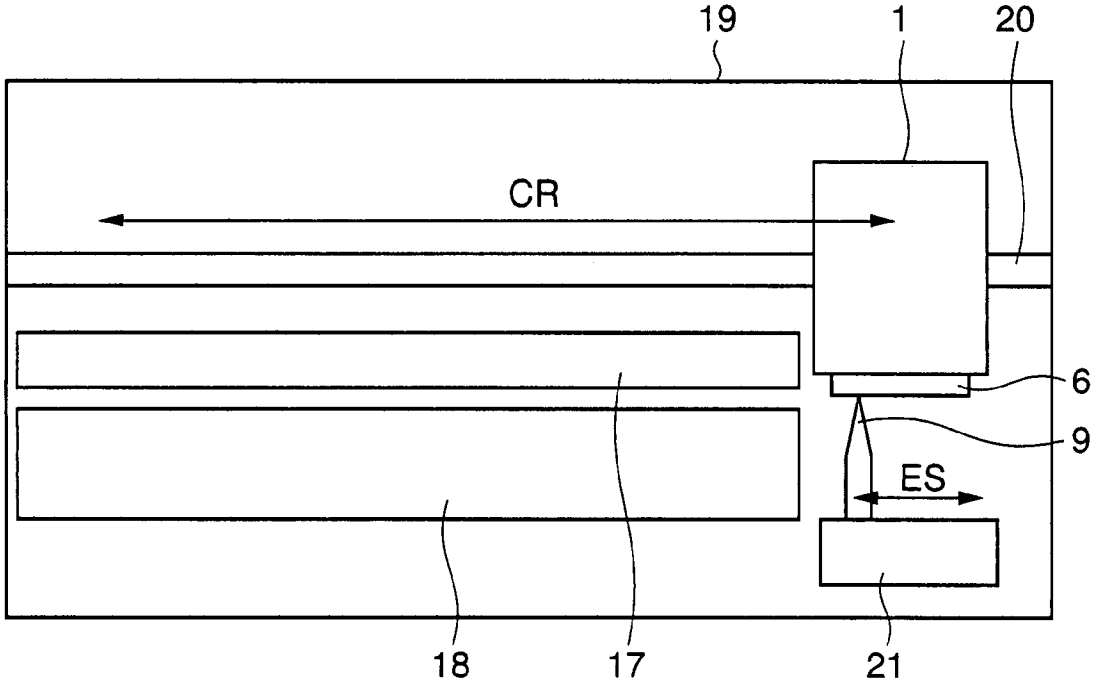

FIGS. 8A and 8B are views for explaining the arrangement of the host computer 70 according to this embodiment. FIG. 8A shows a schematic view of the apparatus when viewed from the front. FIG. 8B shows a schematic view of the apparatus when viewed from the side. The same reference numerals as in FIG. 8B denote the same parts in FIG. 8A.

Figure 9:
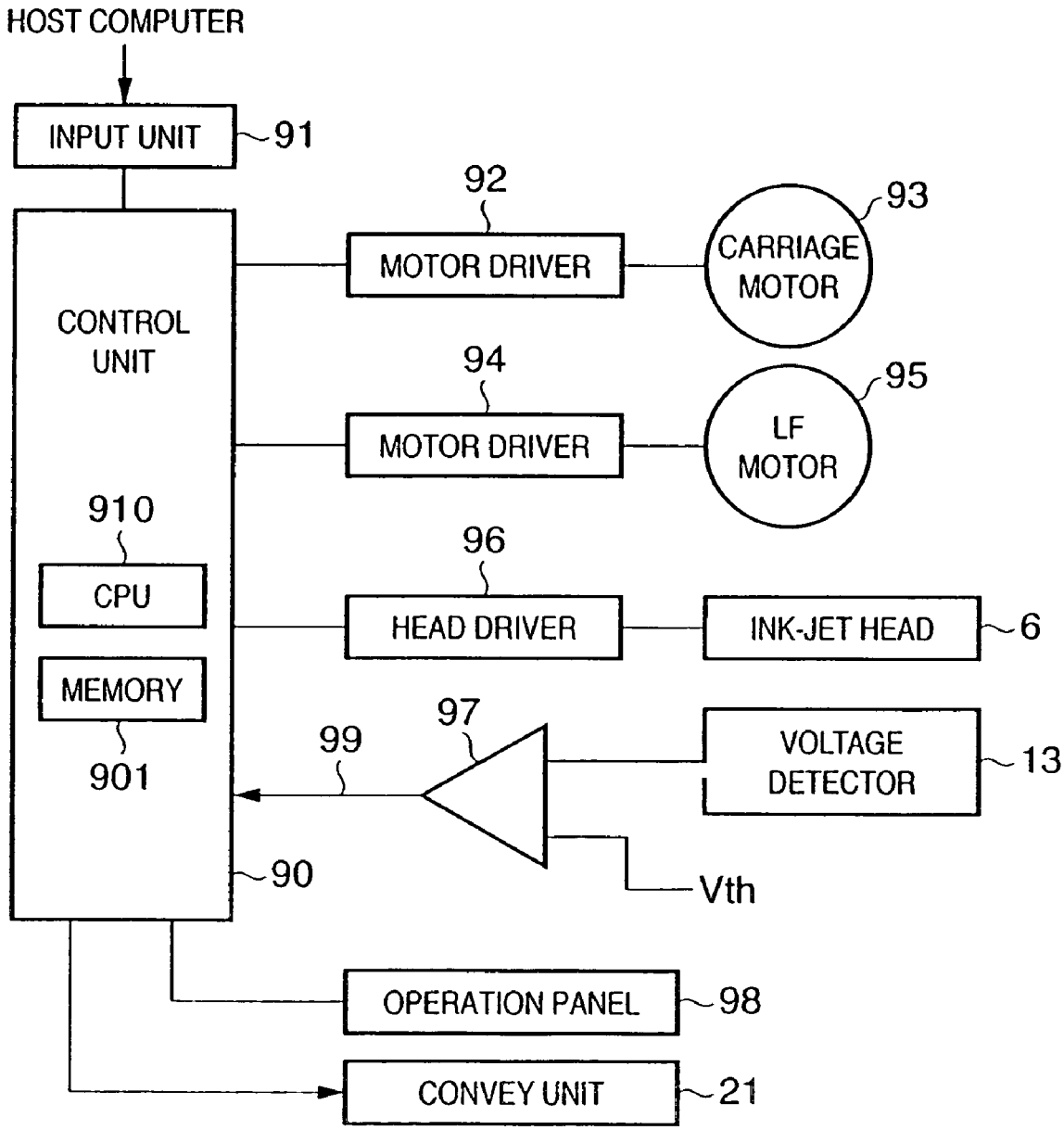
FIG. 9 is a block diagram showing the arrangement of an ink-jet printer apparatus according to this embodiment.

Referring to FIGS. 8A and 8B, the ink cartridge 1 is mounted on a carriage shaft 20 with the ink discharge direction being downward, and is reciprocally moved in the direction indicated by an arrow CR in accordance with the rotation of a carriage motor (93 in FIG. 9). Reference numeral 17 denotes a paper feed roller 17; and numeral 18 denotes a platen. Ink is discharged from the ink-jet head 6 toward a printing medium (print paper) fed between the platen 18 and the paper feed roller 17. When the ink adheres to the printing medium, an image is printed on the printing medium. A head restoring unit (not shown) and the like are arranged at the home position of the ink-jet head 6, and the above electrode 9 is placed near them. The electrode 9 is mounted on the electrode unit 14 described above. The electrode unit 14 can move in the direction indicated by an arrow ES and a direction perpendicular to this drawing surface along the face of the head 6. Reference numeral 21 denotes a convey unit for moving the electrode unit 14. The electrode 9 is moved by the electrode unit 14 to be aligned with a nozzle position where the head 6 is driven to discharge ink. When ink discharge from the nozzle is detected at this position, detection of the states of ink discharge from all the nozzles of the head 6 is started.

In this manner, the states of ink discharge from all the nozzles of the ink-jet head 6 can be discriminated. In this case, a nozzle from which discharge of ink cannot be detected is determined as a non-discharge nozzle. An error warning is then given to the user or corresponding information is sent to the host computer 70. This makes it possible to prevent printing of any faulty image.

FIG. 9 is a block diagram showing the arrangement of the printing apparatus 71 according to this embodiment.

Referring to FIG. 9, reference numeral 90 denotes a control unit which controls the overall operation of the printing apparatus 71 and includes a CPU 910 such as a microprocessor, a memory (RAM and ROM) 901 for storing programs executed by the CPU 910 and various data, and the like; numeral 91 denotes an input unit which controls an interface with the host computer 70 and includes a USB bus interface, an i-Link interface, and the like; numeral 93 denotes a carriage motor which is rotated by a motor driver 92 in accordance with an instruction from the control unit 90 and conveys the ink-jet head 6 integrated with the ink cartridge 1 in the direction indicated by the arrow CR in FIG. 8A; numeral 95 denotes a paper feed motor (LF motor) which is driven by a motor driver 94 in accordance with an instruction from the control unit 90 to rotate the paper feed roller 17 and convey print paper (including an OHP sheet and the like) as a printing medium; numeral 96 denotes a head driver which drives the ink-jet head 6 in accordance with an instruction from the control unit 90; and numeral 97 denotes a voltage comparator which detects whether an output voltage from the voltage detector 13 (FIG. 1) becomes equal to or higher than a predetermined threshold voltage Vth, sets a signal 99 at high level when the output voltage becomes equal to or higher than the threshold voltage, and supplies it to the control unit 90. With this operation, the control unit 90 can detect whether ink is discharged. Reference numeral 98 denotes an operation panel which has various switches to be operated by the user, an LED and buzzer which inform of errors (paper jam, ink shortage, and the like), and the like. In accordance with an instruction from the control unit 90, the convey unit 21 moves the electrode unit 14 to align the electrode 9 and a nozzle (nozzles).

Figure 10:
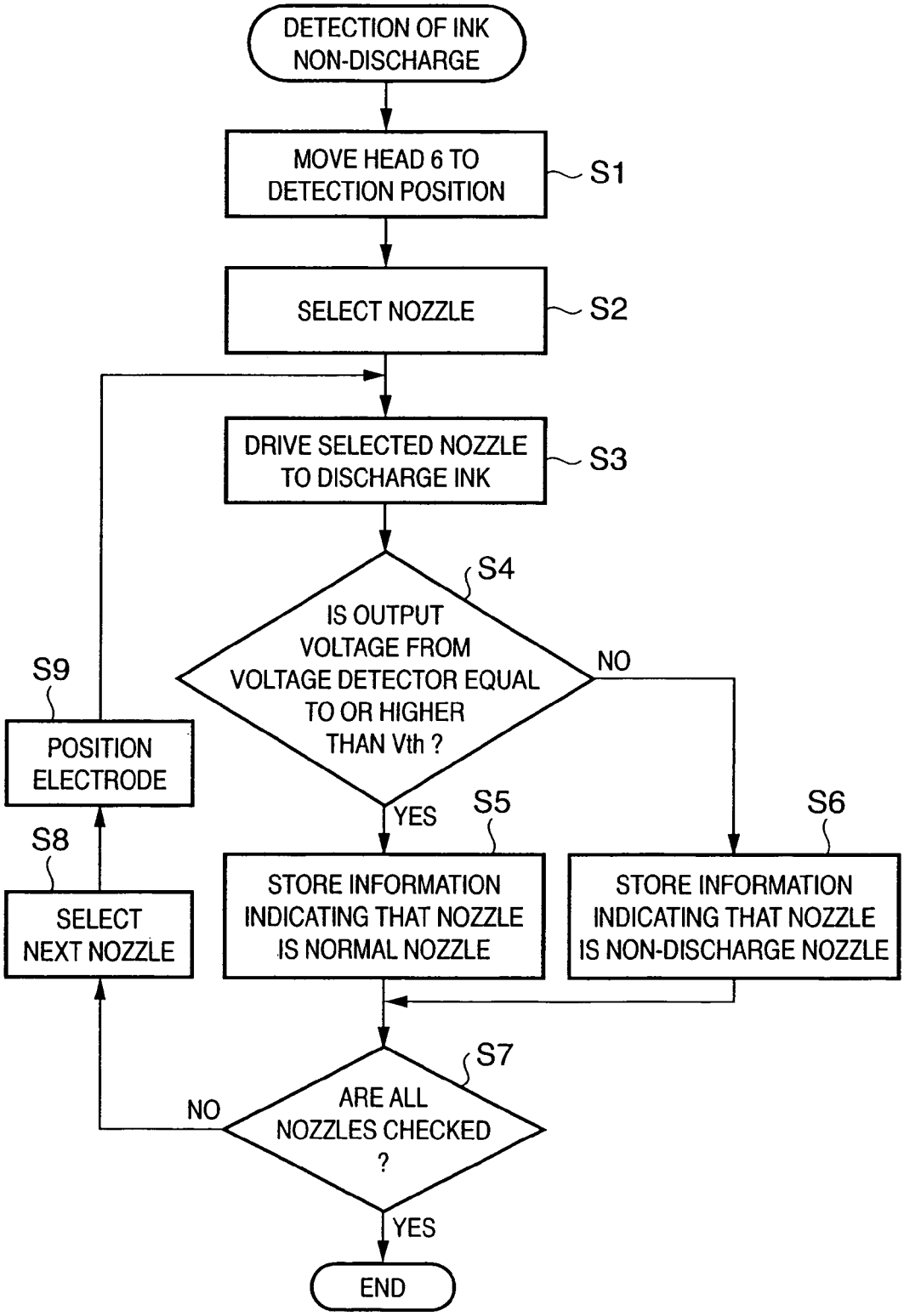
FIG. 10 is a flow chart for explaining a method of detecting ink discharge/non-discharge in the ink-jet printer apparatus according to this embodiment.

FIG. 10 is a flow chart for explaining a method of detecting discharge/non-discharge of ink (liquid) in the liquid discharge detection apparatus or ink-jet printer apparatus according to this embodiment. Assume that the electrode 9 of the electrode unit 14 is a needle-like electrode.

In step S1, the ink-jet head 6 is moved to align a predetermined nozzle (first nozzle) of the ink-jet head 6 with the electrode 9. As described above, when ink is discharged from a predetermined nozzle of the head 6 and the detection of the ink discharge can be confirmed on the basis of the signal 99, the completion of positioning may be determined. When aligning is completed in this manner, the flow advances to step S2 to output "1" as an image signal to the first nozzle of the ink-jet head 6, e.g., the nozzle located at an end of the head. In step S3, the heater of the nozzle is energized to perform ink discharging operation. In step S4, it is checked whether an output signal from the voltage detector 13 has become equal to or higher than the predetermined voltage Vth and the signal 99 has gone to high level within a predetermined period of time. If a high-level signal 99 is detected, the flow advances to step S5 to determine that the nozzle is a normal nozzle and information indicating "normal" is stored in the RAM area of the memory 901 in correspondence with the number of the nozzle. If it is determined in step S4 that the signal 99 based on the output signal from the voltage detector 13 has not gone to high level within the predetermined period of time, the flow advances to step S6 to determine that the nozzle is a non-discharge nozzle and store information indicating "ink non-discharge (abnormal)" in the RAM area of the memory 901 in correspondence with the number of the nozzle.

After the processing in step S5 or S6 is executed in this manner, the flow advances to step S7 to check whether ink discharge/non-discharge checks on all the nozzles of the ink-jet head 6 are complete. If NO in step S7, the flow advances to step S8 to select the next nozzle of the ink-jet head 6. In step S9, the convey unit 21 is driven to position the electrode 9 to the next electrode position. The flow then advances to step S3 to drive the selected nozzle to perform ink discharging operation. In this case, if the width of the electrode 9 is larger than that of one nozzle, one electrode 9 may be used to detect ink droplets from a plurality of nozzles. In this case, therefore, alignment of the electrode 9 conveyed by the convey unit 21 and the nozzle is executed every time ink discharge from a plurality of nozzles is detected.

When ink discharge/non-discharge from all the nozzles of the ink-jet head 6 is detected in the same manner as described above, this processing is terminated.

Figure 11:
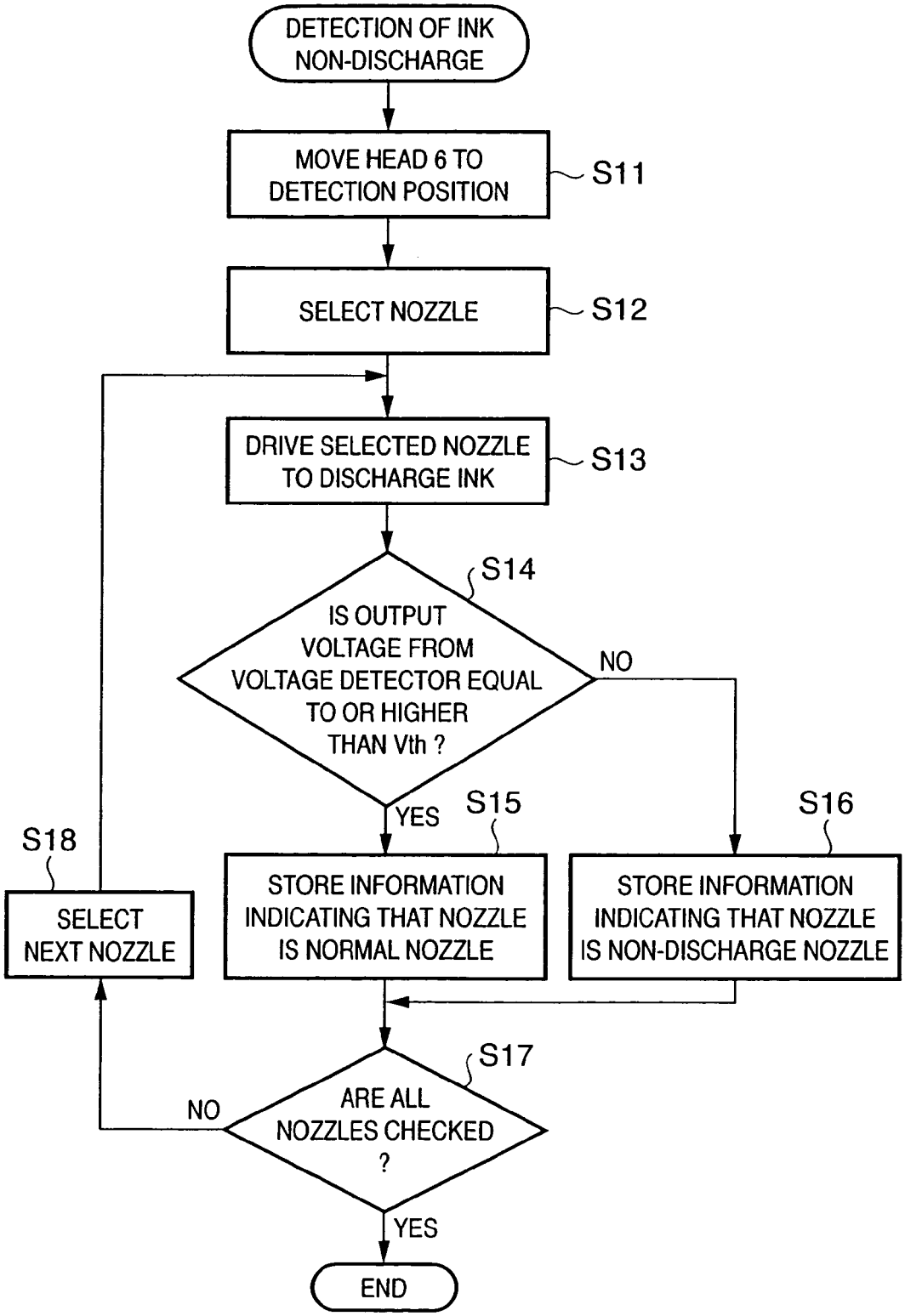
FIG. 11 is a flow chart for explaining a method of detecting ink discharge/non-discharge in an ink-jet printer apparatus using an electrode according to another embodiment.

FIG. 11 is a flow chart for explaining a method of detecting discharge/non-discharge of ink (liquid) in the liquid discharge detection apparatus or ink-jet printer apparatus using the electrode 900 shown in FIGS. 6A and 6B according to another embodiment. Assume that the electrode 900 of the electrode unit 14 has a width W almost equal to the width of the nozzle array of the ink-jet head 6, as shown in FIGS. 6A and 6B.

In step S11, the ink-jet head 6 is moved to align the ink-jet head 6 with the electrode 900. As described above, when ink is discharged from a predetermined nozzle of the head 6 and the detection of the ink discharge by the electrode 900 can be confirmed on the basis of the signal 99, the completion of positioning may be determined. When the alignment of the ink-jet head 6 with the electrode 900 is completed in this manner, the flow advances to step S12 to output "1" as an image signal to the first nozzle of the ink-jet head 6, e.g., the nozzle located at an end of the head. In step S13, the heater of the nozzle is energized to perform ink discharging operation. In step S14, it is checked whether an output signal from the voltage detector 13 has become equal to or higher than the predetermined voltage Vth and the signal 99 has gone to high level within a predetermined period of time. If a high-level signal 99 is detected, the flow advances to step S15 to determine that the nozzle is a normal nozzle and information indicating "normal" is stored in the RAM area of the memory 901 in correspondence with the number of the nozzle. If it is determined in step 514 that the signal 99 based on the output signal from the voltage detector 13 has not gone to high level within the predetermined period of time, the flow advances to step S16 to determine that the nozzle is a non-discharge nozzle and store information indicating "ink non-discharge (abnormal)" in the RAM area of the memory 901 in correspondence with the number of the nozzle. After the processing in step S15 or S16 is executed in this manner, the flow advances to step S17 to check whether ink discharge/non-discharge checks on all the nozzles of the ink-jet head 6 are complete. If NO in step S17, the flow advances to step S18 to select the next nozzle of the ink-jet head 6. The flow then advances to step S13 to drive the selected nozzle to perform ink discharging operation. When ink discharge/non-discharge from all the nozzles of the ink-jet head 6 is detected in the same manner as described above, this processing is terminated.

Note that if this ink-jet printer is desired for, for example, color printing, and has a plurality of ink-jet heads corresponding to a plurality of colors, ink discharge/non-discharge from all the nozzles of all the ink-jet heads can be detected by executing similar processing for the respective heads for the respective colors.

In the embodiments of the present invention, ink is used as a detection target liquid. However, the present invention can also be applied to liquids, other than ink, such as reaction solutions and chemicals. In addition, an ink-jet head is not limited to a bubble-jet type ink-jet head, and the present invention can also be applied to a piezoelectric type ink-jet head.

If the electrode unit 14 can be moved, ink discharge/non-discharge from each nozzle or each nozzle of each head can be detected while the position of the ink-jet head 6 is fixed and the electrode 9 is moved.

Referring to FIG. 9, a latch circuit for latching the state of the output signal 99 from the voltage comparator 97 may be arranged to allow the control unit 90 to detect ink discharge/non-discharge on the basis of an output from the latch circuit. This makes it possible to cope with a case wherein the signal 99 has a small pulse width.

The embodiments of present invention described above have exemplified a printing apparatus, which comprises means (e.g., an electrothermal transducer, a laser beam, and the like) for generating heat energy as energy utilized for the execution of ink discharge, and causes a change in state of ink by the generated heat energy, among the ink-jet printing schemes. According to this scheme, a high-density, high-resolution printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of so-called on-demand and a continuous type systems. Particularly, in the case of the on-demand type, the system is effective because, by applying at least one driving signal, which corresponds to printing information and gives a rapid temperature rise exceeding film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head, as described in the above embodiments which can be electrically connected to the apparatus main unit and can receive ink from the apparatus main unit upon being mounted on the apparatus main units but also a cartridge type printing head in which an ink tank is integrally arranged on the printing head itself, can be applicable to the present invention.

It is preferable to add restoring means for the printing head, preliminary auxiliary means, and the like provided as an arrangement of the printer of the present invention since the printing operation can be further stabilized. Examples of such means include, for printing head, pressurization or suction means, and preliminary heating means using electrothermal transducers, another heating element, or a combination thereof. It is also effective for stable printing to provide a preliminary discharge mode which performs discharge independently of printing.

Although ink is described as a fluid in the above embodiments of the present invention, ink which solidifies at the room temperature or lower, or ink which softens or liquefies at the room temperature may be used. Alternatively, in the ink-jet scheme, since temperature control is performed such that the temperature of ink itself is controlled in a range from 30° C. or higher to 70° C. or lower so as to make the viscosity of the ink fall within a stable discharge range, any ink which liquefies when a printing signal is supplied may be used.

In addition, in order to prevent a temperature rise caused by heat energy by positively utilizing it as energy for causing a change in state of the ink from a solid state to a liquid state, or to prevent evaporation of the ink, ink which is solid in a non-use state and liquefies upon heating may be used. In any case, ink which liquefies upon application of heat energy according to a printing signal and is discharged in a liquid state, ink which begins to solidify when it reaches a printing medium is applicable to the present invention. In the present invention, the above film boiling system is most effective for each ink described above.

In addition, the printing apparatus of the present invention may be used in the form of a copying machine combined with a reader, and the like, or a facsimile apparatus having a transmission/reception function in addition to a printer integrally or separately mounted as an image output terminal of information processing equipment such as a computer.

The present invention can be applied to a system constituted by a plurality of devices (e.g., host computer, interface, reader and printer) or to an apparatus comprising a single device (e.g., copying machine or facsimile machine).

The objects of the present invention are also achieved by supplying a storage medium (or a recording medium), which records a program code of a software program that can realize the functions of the above embodiments to the system or apparatus, and reading out and executing the program code stored in the storage medium by a computer (or a CPU or MPU) of the system or apparatus. In this case, the program code itself read out from the storage medium realizes the functions of the above embodiments, and the storage medium which stores the program code constitutes the present invention. The functions of the above embodiments may be realized not only by executing the readout program code by the computer but also by some or all of actual processing operations executed by an OS (operating system) running on the computer on the basis of an instruction of the program code.

Furthermore, the functions of the above embodiments may be realized by some or all of actual processing operations executed by a CPU or the like arranged in a function extension card or a function extension unit, which is inserted in or connected to the computer, after the program code read out from the storage medium is written in a memory of the extension card or unit.

As has been described above, according to this embodiment, the following effects can be obtained.

(1) Even if the amount of liquid discharged is small, discharge of the liquid can be reliably detected.

(2) Since detection is not based on the electric field with which a liquid is charged, the voltage to be applied to the liquid can be lowered, thus improving safety.

(3) Since detection can be done with one discharged liquid column, the detection can be done in a short period of time, resulting in a reduction in the amount of liquid waste.

(4) Since a fluctuation or variation in discharge of a liquid can also be detected, the reliability in detecting discharge/non-discharge can be improved. This makes it possible to improve the quality of an image to be printed.

The present invention is not limited to the above embodiments and various changes and modifications can be made within the spirit and scope of the present invention. Therefore, to apprise the public of the scope of the present invention, the following claims are made.

We claim:

1. A liquid discharge detection apparatus which detects a liquid discharged from a liquid discharge head, comprising:

an electrode, in the form of a plate edge, located at a position where the liquid discharged from the liquid discharge head can come into contact with said electrode before separating from the head;

voltage application means for applying a predetermined voltage to a circuit including the liquid discharge head and said electrode; and detection means for detecting a discharge state on the basis of a current flowing in the circuit, wherein the current flows into the liquid before the liquid is separated from the liquid discharge head.

2. An apparatus according to claim 1, wherein the liquid discharge head comprises an orifice for discharging the liquid, the liquid is discharged in a columnar shape from the orifice of the liquid discharge head at the beginning of discharge, and said electrode is placed at a position where said electrode can oppose the liquid discharge head and is spaced apart therefrom by a distance that allows a distal end portion of the columnar liquid discharged from the liquid discharge head to come into contact with said electrode while a proximal end portion of the liquid is in contact with the orifice.

3. An apparatus according to claim 1, wherein said electrode has a surface shape inclined with respect to a discharge direction of the liquid discharge head.

4. An apparatus according to claim 1, wherein a width of said electrode is substantially equal to a width of the liquid discharge head.

5. An apparatus according to claim 1, wherein said detection means forms the circuit into a closed circuit when the liquid discharge head and said electrode are connected to each other through the liquid discharged from the liquid discharge head, and detects discharge/non-discharge of a liquid from the liquid discharge head on the basis of the current flowing in the closed circuit.

6. An apparatus according to claim 5, wherein said detection means has voltage detection means for detecting a voltage generated between two ends of a resistor from a current flowing in the closed circuit, and when the voltage is not less than a predetermined voltage, detects that a liquid is discharged from the liquid discharge head.

7. An apparatus according to claim 1, wherein the liquid discharge head has a plurality of discharge nozzles, and further comprises:

driving means for selecting and driving each nozzle of the plurality of discharge nozzles, and means for detecting a discharge state of each of the plurality of discharge nozzles of the liquid discharge head on the basis of detection by said detection means which is synchronized with driving by the driving means.

8. An apparatus according to claim 1, wherein a gap L between said electrode and the liquid discharge head satisfies $5\ \mu m < L \leqq 200\ \mu m$.

9. A liquid discharge detection method in an apparatus having an electrode located at a position where before one end of a liquid discharged from a liquid discharge head separates from the head, the other end of the liquid comes into contact with the electrode, and detecting a discharge state of the liquid discharge head, the method comprising the steps of:

providing the electrode in the form of a plate edge applying a predetermined voltage to a circuit including the liquid discharge head and the electrode driving the liquid discharge head to discharge liquid; and detecting a discharge state of the liquid from the liquid discharge head on the basis of a current flowing in the circuit via the liquid.

10. A method according to claim 9, wherein the liquid discharge head comprises an orifice for discharging the liquid, the liquid is discharged in a columnar shape from the orifice of the liquid discharge head at the beginning of discharge, and the electrode is placed at a position where the electrode can oppose the liquid discharge head and is spaced apart therefrom by a distance that allows a distal end portion of the columnar liquid discharged from the liquid discharge head to come into contact with the electrode while a proximal end portion of the liquid is in contact with the orifice.

11. A method according to claim 9, wherein the electrode has a surface shape inclined with respect to a discharge direction of the liquid discharge head.

12. A method according to claim 9, wherein a width of the electrode is substantially equal to a width of the liquid discharge head.

13. A method according to claim 9, wherein in detection of the discharge state, when the circuit becomes a closed circuit due to the liquid discharged from the liquid discharge head, a voltage is generated between two ends of a resistor by a current flowing in the closed circuit, and it is determined, if the voltage is not less than a predetermined voltage, that a liquid is discharged from the liquid discharge head.

14. A method according to claim 9, wherein the liquid discharge head has a plurality of discharge nozzles, and the method further comprises:

a driving step of selecting and driving each nozzle of the plurality of discharge nozzles, and a step of detecting a discharge state of each of the plurality of discharge nozzles of the liquid discharge head on the basis of detection of the current which is synchronized with driving in the driving step.

15. A method according to claim 9, wherein a gap L between the electrode and the liquid discharge head satisfies $5\ \mu m < L \leqq 200\ \mu m$.

16. An ink-jet printer apparatus for detecting an ink discharged from an ink-jet head, comprising:

an electrode, in the form of a plate edge, located at a position where the ink discharged from the ink-jet head can come into contact with said electrode before separating from the ink-jet head;

voltage application means for applying a predetermined voltage to a circuit including the ink-jet head and said electrode; and detection means for detecting a discharge state on the basis of a current flowing in the circuit, wherein the current flows into the ink before the ink is separated from the ink-jet head.

17. An apparatus according to claim 16, wherein the ink-jet head comprises an orifice for discharging the ink, the ink is discharged in a columnar shape from the orifice of the ink-jet head at the beginning of discharge, and said electrode is placed at a position where said electrode can oppose the ink-jet head and is spaced apart therefrom by a distance that allows a distal end portion of the columnar ink discharged from the ink-jet head to come into contact with said electrode while a proximal end portion of the ink is in contact with the orifice.

18. An apparatus according to claim 16, wherein said electrode has a surface shape inclined with respect to a discharge direction of the ink-jet head.

19. An apparatus according to claim 16, wherein a width of said electrode is substantially equal to a width of the ink-jet head.

20. An apparatus according to claim 16, wherein said detection means forms the circuit into a closed circuit when the ink-jet head and said electrode are connected to each other through the ink discharged from the ink-jet head, and detects discharge/non-discharge of the ink from the ink-jet head on the basis of a current flowing in the closed circuit.

21. An apparatus according to claim 20, wherein said detection means has voltage detection means for detecting a voltage generated between two ends of a resistor from a current flowing in the closed circuit, and when the voltage is not less than a predetermined voltage, detects that the ink is discharged from the ink-jet head.

22. An apparatus according to claim 16, wherein the ink-jet head has a plurality of discharge nozzles, and further comprising:

driving means for selecting and driving each nozzle of the plurality of discharge nozzles, and means for detecting a discharge state of each of the plurality of discharge nozzles of the ink-jet head on the basis of detection by said detection means which is synchronized with driving by the driving means.

* * * * *

UNITED STATES PATENT AND TRADEMARK OFFICE

CERTIFICATE OF CORRECTION

PATENT NO. : 6,994,417 B2
APPLICATION NO. : 10/863278
DATED : February 7, 2006
INVENTOR(S) : Murayama et al.

It is certified that error appears in the above-identified patent and that said Letters Patent is hereby corrected as shown below:

COLUMN 2
Line 25, "for-explaining" should read --for explaining--.

COLUMN 9
Line 24, "the" should be deleted.

COLUMN 12
Line 8, "edge" should read --edge;--.
Line 10, "electrode" should read --electrode;--.

Signed and Sealed this

Nineteenth Day of June, 2007

JON W. DUDAS
*Director of the United States Patent and Trademark Office*